United States Patent [19]

Schwarting et al.

[11] 4,256,345

[45] Mar. 17, 1981

[54] SCRAPER CHAIN CONVEYOR WITH RACK FOR THE CHAINLESS FEED OF WINNING MACHINES

[75] Inventors: Karl-Heinz Schwarting, Voerde; Roland Guenther, Wesel, both of Fed. Rep. of Germany

[73] Assignee: Gutehoffnungshütte Sterkrade AG, Fed. Rep. of Germany

[21] Appl. No.: 94,650

[22] Filed: Nov. 15, 1979

[30] Foreign Application Priority Data

Nov. 18, 1978 [DE] Fed. Rep. of Germany ..... 2850187

[51] Int. Cl.[3] ..... E21C 35/20

[52] U.S. Cl. ..... 299/43; 198/735

[58] Field of Search ..... 198/735, 860, 861; 299/42, 43, 64

[56] References Cited

U.S. PATENT DOCUMENTS

| | | | |
|---|---|---|---|
| 4,006,937 | 2/1977 | Curtis | 299/43 |
| 4,103,975 | 8/1978 | Funke et al. | 299/43 |
| 4,155,600 | 5/1979 | Lanfermann et al. | 299/43 |
| 4,184,715 | 1/1980 | Lanfermann | 299/43 |
| 4,186,970 | 2/1980 | Minke et al. | 299/43 |

FOREIGN PATENT DOCUMENTS

| | | | |
|---|---|---|---|
| 826874 | 4/1938 | France | 198/735 |
| 46934 | 9/1939 | Netherlands | 198/735 |
| 2005215 | 4/1979 | United Kingdom | 198/860 |

*Primary Examiner*—Joseph E. Valenza
*Attorney, Agent, or Firm*—McGlew & Tuttle

[57] ABSTRACT

A chain conveyor section of a longwall conveying device for underground mining of a longwall using a winning machine riding on the conveying device comprising a trough member defining a trough adapted to receive a scraper chain therein the trough member having one flanged side wall and one unflanged side wall positionable next to the longwall, a main rack section connected to the unflanged side wall extending over the trough and toward the flanged side wall for holding one end of the scraper in the trough, and an intermediate rack segment pivotally connected to the main rack segment for interconnecting at least the unflanged side wall sides of adjacent chain conveyor sections of the conveying device.

5 Claims, 3 Drawing Figures

SCRAPER CHAIN CONVEYOR WITH RACK FOR THE CHAINLESS FEED OF WINNING MACHINES

FIELD AND BACKGROUND OF THE INVENTION

The present invention relates in general to mining devices and, in particular to a new and useful scraper chain conveyor having a rack thereon for the chainless feed of winning machines which extract material from the longwall of an underground mine, such as a coal mine, where the conveyor comprises a plurality of conveyor sections which have junctions therebetween that are bridged by feed segments, the feed segments connected together to form the rack.

In the course of the development to chainless feeding systems for winning machines that remove material from the longwall or open face of mines in underground mining, that is, in so-called long front mining, a number of proposals have been made and also partly realized in practice. The winning machines were provided, to this end, with separate drives and road on toothed rods or racks that were necessary for the feed or travel of the winning machines across the longwall. These racks were associated in various ways with the scraper chain conveyors which were used as longwall conveying devices for conveying the material removed from the wall out of the mine.

In known chainless feeding systems, the drive for the winning machine is effected on the scraper chain conveyor at the cog side or side of the conveyor away from the mine face (e.g. DOS 2530 754). This arrangement is suitable when the longwall is sufficiently thick, so that the winning machine can be arranged above the conveyor.

If the longwall is thin, however, the winning machine must be arranged at the face side of the conveyor, next to the longwall, so that the longwall conveyor has a sufficiently large cross section for conveying. Because of the anticipated decrease in the thickness of the seam, more and more of the above-mentioned conditions can be expected.

SUMMARY OF THE INVENTION

The object of the invention is to provide a scraper chain conveyor which is used as a longwall conveying device, where a winning machine is guided at the face side of the conveying device and where the following criteria have been taken into consideration:

1. The feed of the winning machine should be uniform, division errors should be minimized.
2. Reaction forces of the feed produced by the winning machine must be safely conducted into the floor of the mine seam.
3. Adaptation to undulations of the floor must be possible.
4. Moving operations must be possible for moving the conveyor toward the face.
5. Clear guidance of the winning machine must be ensured.
6. Constant meshing of a pinion for the winning machine which drives the machine along the conveyor must always be maintained.
7. Mined material must not hinder the engagement conditions of the feed drive.
8. Overall height of the toothed rod or rack on which the pinion rides at the face side must be minimal, so that the loading of the mined material on the conveyor is not hindered and the overall height of the machine remains low.

9. The toothed rod or rack should be designed as or include a loading ramp for conducting the mined material into a trough of the conveyor.
10. Operating and assembly costs must be minimal.
11. Feed segments of the conveyor should be readily interchangeable.

The state of art includes segment type toothed rods or racks in the form of drive shafts, negative chain profiles or special toothings. These known feed systems are all connected to the unchanged conventional trough sections. The toothed rods are thus either arranged above the flange of the trough section of the conveyor, which leads necessarily to caking of the mined material between flange and toothed rod.

Another known type of fastening between conveyor sections consists in the lateral arrangement of the toothed rod above the flange of the conveyor trough sections. The mined material does not cake here, because it is pressed through the intervals of the toothing directly on the conveyor trough and is entrained by the scraper elements of the conveyor, but in this arrangement the conveying cross section is greatly reduced.

The invention meets the above mentioned criteria and avoids the disadvantages that appear in the embodiments according to the state of the art in that the upper side wall of the conveyor at the face side is flangeless and the toothed rod or rack comprises a main and intermediate segments which are attached and secured on the upper edge of the flangeless side wall of the conveyor trough. The main segments of the toothed rod, which are forked at both ends for connection with the intermediate segments by means of drive shaft bolts, provide for the connection of the conveyor sections at the face side with the side bars of the main and intermediate feed segments extending toward the center of the conveyor trough designed to hold down the moving scrapers of the conveyor in the trough and the main segments are provided with a beveled, box-type loading ramp which extends in a direction toward the face, over the length of the side wall of the conveyor section.

The toothed rod, composed of main and intermediate segments, can also be attached later on any single or double chain scraper conveyor of any known type. To this end it is only necessary to change the side of the conveyor slightly at the face side, namely to separate the top therefrom.

In the connection of the feed segments with drive shaft bolts, the drive shaft bolts are mounted with sufficient play in their bores so that the necessary spherical movements can be performed between conveyor section where they are required to conform to a wavy floor next to the seam or when moving the longwall conveyor device. Division or separation errors between the segments are expected within minimal limits.

The side bars forming each of the feed segments on the side of each segment toward the center of the conveyor, provide the function of holding down the scrapers of the chain conveyor, which function is performed, in conventional scraper chain conveyors, by the top flange of the side walls thereof.

Mined material which presses through the intervals of the drive shaft drops directly into the trough of the conveyor and is conveyed from there.

A special advantage of the arrangement according to the invention is that the overall height of the conveyor with the attached feed segments could be considerably reduced relative to the known conveying devices with feed means. This has a favorable effect on the loading behavior and the stresses from external forces.

The special design of the bottom part of the main segments as a loading ramp ensures that the lateral edges of the loading ramps of the trough sections can sufficiently overlap in the horizontally bent-off state, so that no mined material can get into the intervals or spaces between conveyor sections.

The straight surfaces on the drive shaft and their junctions ensure the problem-free guidance of the winning machine. Reaction forces from the feed of the winning machine are conducted directly over the feed segments into the floor.

Accordingly, another object of the present invention is to provide a chain conveyor section of a longwall conveying device for underground mining of a longwall using a winning machine riding on the conveying device comprising, a trough member defining a trough adapted to receive a scraper chain therein, the trough having one flanged side wall and one unflanged side wall positionable next to the longwall, a main rack segment connected to said flangeless side wall extending over said trough and toward said flanged side wall for holding one end of the scraper in the trough, and an intermediate rack segment pivotally connected to said main rack segment and for interconnecting at least the unflanged side wall sides of adjacent chain conveyor sections of the conveying device.

Another object of the present invention is to provide a chain conveyor section wherein the main rack segment includes two forked ends each having bores therethrough, said intermediate segment having a tongue end with a bore therethrough, said tongue disposed in one of said forked ends with all of said bores being substantially aligned, said shaft bolt extending through said bores for connecting said main segment to said intermediate segment.

A still further object of the present invention is to provide the main segment with a beveled box shaped loading ramp extending from the side of the chain conveyor section toward the longwall and the length of the conveyor section.

A still further object of the present invention is to provide a chain conveyor section which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
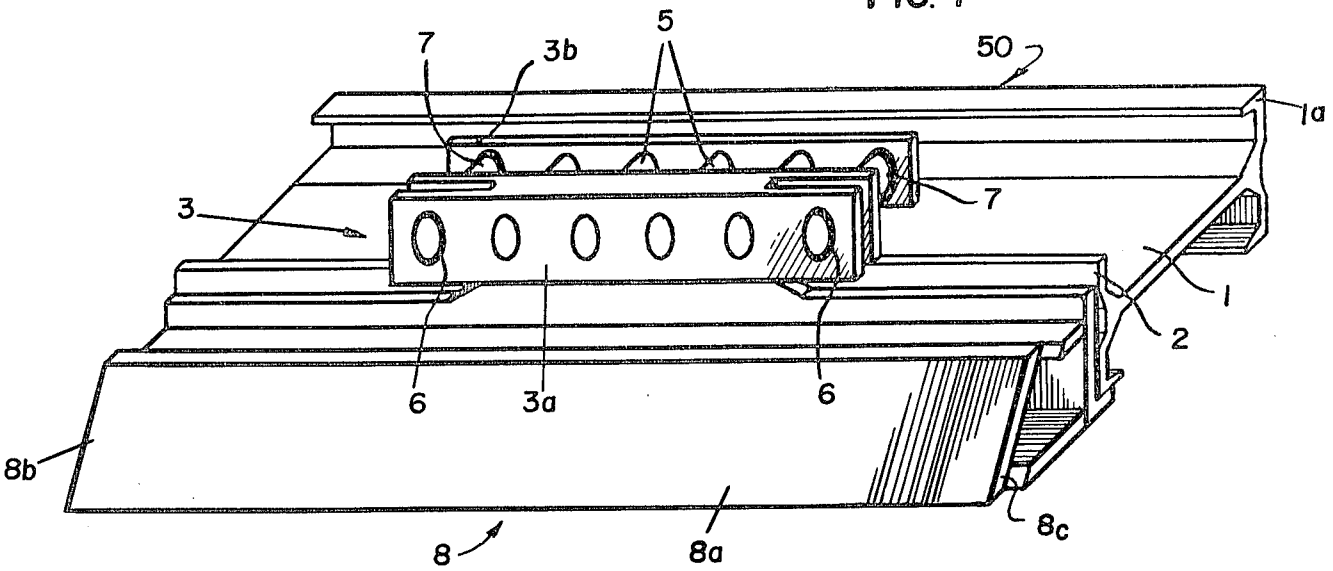
FIG. 1 is a top perspective view of a chain conveyor section constructed in accordance with the invention viewed from the longwall side.
Figure 3:
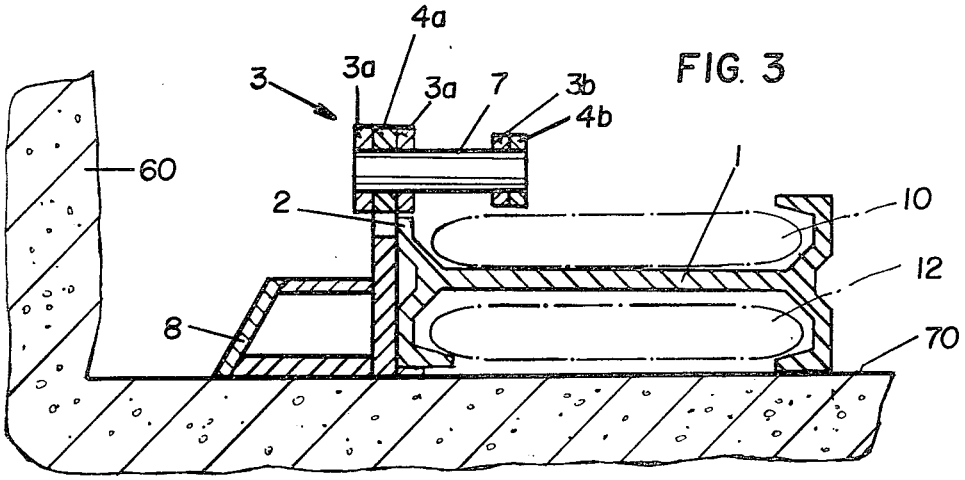
FIG. 3 is a sectional view taken through a junction between a main segment and an intermediate segment of the device shown in FIG. 1.

Turning to the drawings in particular, the invention embodied therein in FIG. 1 comprises a chain conveyor section generally designated 50 of a longwall conveying device constructed of a plurality of such conveyor sections connected together and extending along a longwall of an underground mine shown at 60 in FIG. 3 such as for example, the face of an underground coal seam. Turning back to FIG. 1, the chain conveyor section comprises a trough member or section 1 having one flanged side wall 1*a* and one unflanged side wall 2. As with prior art devices, the trough member 1, as shown in FIG. 3, has a top trough for guiding a top conveying strand 10 of a scraper chain shown only in dot/dash line. The trough member 1 also includes a bottom trough for guiding a bottom return strand 12 of the scraper chain. While the bottom strand 12 is retained in the bottom trough by two flange portions of the side walls, the top strand 10 is retained in the top trough at the right hand side or side away from the longwall or face 60 by the inwardly extending flange of side wall 1*a* with the left hand or longwall side of the strand 10 being kept in the top trough by a portion of the rack hereinafter to be described.

Figure 2:
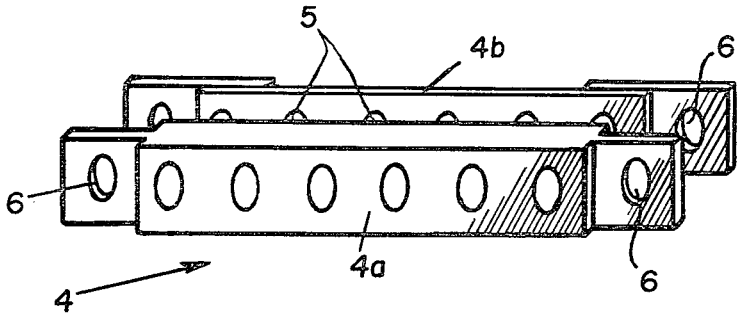
FIG. 2 is a top perspective view of an intermediate segment for interconnecting adjacent chain conveyor sections of the overall conveying device on at least the longwall side of the device.

Turning back to FIG. 1, a main feed segment generally designated 3 is shown which is shorter in a longitudinal direction than the conveyor section 50. Main segment 3 comprises two side bars 3*a* and 3*b* and cross bolts or rods 5 which interconnect the two side bars. As seen in FIG. 2, main segments 3 of adjacent conveyor sections 50 in the overall conveying device are interconnected by intermediate segments generally designated 4 which are of a similar construction to the main segment 3 in having side bars 4*a* and 4*b* interconnected by bolts or cross shafts 5. The opposite ends of side bars 3*a* are forked in construction having through bores 6 with the opposite ends of side bars 4*a* having tongue constructions with through bores 6 as well. The main and intermediate segments are interconnected by inserting the tongues of side bars 4*a* into the forked ends of side bars 3*a* and inserting a drive or shaft bolt 7 therethrough. A spherically pivotable engagement is thereby realized between each main segment and each intermediate segment in that the bores 6 can be formed as ovals to permit horizontal as well as vertical pivoting. This flexibility is necessary to compensate for undulations in the floor mine 50 adjacent to the longwall 60 and also to permit the lateral movement of the conveying device toward the longwall 60 as material is removed therefrom.

The connected main and intermediate segments along the overall conveying device form a rack or toothed rod for receiving a pinion of a winning machine riding therealong. In accordance with the prior art such winning machines which operate in a chainless manner include pinions having teeth which, in the embodiment of the invention shown, fall between an engaged against the cross bolts 5 and 7 to move the winning machine transversely across the longwall 60. The winning machine is not shown and not required for the understanding of the present invention.

In accordance with the invention, since the main segments 3 are shorter than the overall chain conveyor section 50, the intermediate segments 4 bridge the junctions between adjacent conveyor sections in the conveying device. The intermediate segments 5 also form a connection between adjacent conveyor sections on the longwall or face side of the conveying device. As shown in FIG. 3, the connected ends of side bars 3*b* and 4*b* are also provided with through bores 6 and overlap to be pivotally connected by the drive or shaft bolt 7. These side bars 3*b* and 4*b* of the rack or toothed rod extend toward the center of the trough member 1 and over the trough for holding the scraper conveyor strand 10 down in its top trough on the longwall side thereof. The side bars 3*b* and 4*b* thus take over the function of the flanges of the side walls.

The main segments 3 are provided with a beveled or angled box-shaped load ramp 8 which extends toward the longwall side and over the length of the side wall of the conveyor section 50. As seen from FIG. 1, the bevel member 8*a* of this loading ramp extends, at one end 8*b* beyond the length of the trough member 1, while the bevel member 8*a* at the other end 8*c* is somewhat shorter than the trough member 1. This ensures that the end of the loading ramp will sufficiently overlap, even in the horizontally bent-off state, so that no mined material can get into the intervals between trough members.

Main and intermediate segments 3 and 4 have the advantage that they are readily interchangeable.

As it can be seen from FIG. 3 the scraper chain conveyor with the feed segments arranged at the mine face side has a relatively low overall height, and due to the fact that the winning machine is arranged at the face side, a sufficiently large conveying cross section remains for the mined material to be conveyed on the longwall conveying device.

The design of the conveyor according to the invention with integrated feed segments and loading ramps at the face end forms in an advantageous manner a support for the winning machine.

While a specific embodiment of the invention has been shown and described in detail to illustrate the application of the principles of the invention, it will be understood that the invention may be embodied otherwise without departing from such principles.

What is claimed is:

1. A chain conveyor section of a longwall conveying device for underground mining of a longwall using a winning machine riding on the conveying device comprising: a trough member defining a trough adapted to receive a scraper chain therein, the trough member having one flanged side wall and one unflanged side wall positionable next to the longwall, a main rack section connected to said unflanged side wall extending over said trough and toward said flanged side wall for holding one end of the scraper in the trough, and an intermediate rack segment pivotally connected to said main rack segment for interconnecting at least the unflanged side wall sides of adjacent chain conveyor sections of the conveying device said rack sections having passages through said sections to permit passage of mined material into the conveying run of the scraper conveyor to prevent caking of the material between said rack sections and the drive means on the winning machine.

2. A chain conveyor section according to claim 1 wherein said main rack segment has opposite forked ends with bores therethrough, said intermediate segment having opposite tongue ends with bores therethrough, one of said tongue ends of said intermediate segment disposed in one of the forked ends of said main segment with said bores aligned, and a shaft bolt extending through said aligned bores for pivotally connecting said main rack segment to said intermediate rack segment.

3. A chain conveyor section according to claim 2 wherein each of said main and intermediate rack segments comprise spaced apart side bars with a plurality of cross bolts extending thereacross to form the teeth of said main and intermediate rack segments, one side bar of said main rack segment having said opposite forked ends and one side bar of said intermediate rack segment having said opposite tongue ends.

4. A chain conveyor section according to claim 1 wherein said main rack segment includes a beveled box-shaped loading ramp adapted to extend toward the longwall from said unflanged side wall.

5. A chain conveyor section according to claim 4 wherein said beveled box-shaped loading ramp includes a bevel member extending beyond said unflanged side wall on one end thereof and being shorter than said unflanged side wall on an opposite end thereof whereby junctions between adjacent chain coveyor sections of the conveying device are overlapped by said bevel member.

* * * * *